US008763553B1

(12) United States Patent
Shannehan et al.

(10) Patent No.: US 8,763,553 B1
(45) Date of Patent: Jul. 1, 2014

(54) MEDICINE TRACKER AND DOSE INDICATOR

(76) Inventors: Leslie B. Shannehan, Fairfield, CT (US); Timothy J. Shannehan, Fairfield, CT (US)

( * ) Notice: Subject to any disclaimer, the term of this patent is extended or adjusted under 35 U.S.C. 154(b) by 266 days.

(21) Appl. No.: 13/030,339

(22) Filed: Feb. 18, 2011

Related U.S. Application Data

(60) Provisional application No. 61/306,775, filed on Feb. 22, 2010.

(51) Int. Cl.
*G09F 9/00* (2006.01)

(52) U.S. Cl.
USPC ..... 116/308

(58) Field of Classification Search
USPC ..... 116/308, 307, 309, 306; 215/216; 292/311; 206/459.1, 478, 806; 40/310, 40/311, 316
See application file for complete search history.

(56) References Cited

U.S. PATENT DOCUMENTS

| | | | | | |
|---|---|---|---|---|---|
| 332,208 | A | * | 12/1885 | Noel | 116/308 |
| 3,248,018 | A | * | 4/1966 | Fleischman | 222/196 |
| 4,345,541 | A | | 8/1982 | Villa-Real | 116/308 |
| 4,347,804 | A | | 9/1982 | Villa-Real | 116/308 |
| 4,365,722 | A | | 12/1982 | Kramer | 215/220 |
| 4,383,692 | A | * | 5/1983 | Proctor | 277/606 |
| 4,705,182 | A | | 11/1987 | Newel-Lewis | 215/230 |
| 4,749,093 | A | | 6/1988 | Trick | 215/220 |
| 4,913,083 | A | | 4/1990 | Valvo et al. | 116/308 |
| 4,920,912 | A | * | 5/1990 | Kirkling | 116/308 |
| 4,985,879 | A | | 1/1991 | Owens | 368/89 |
| 5,011,032 | A | | 4/1991 | Rollman | 215/230 |
| 5,271,353 | A | | 12/1993 | Besthorne | 116/308 |
| 5,279,422 | A | | 1/1994 | Adams | 206/534 |
| 5,299,701 | A | * | 4/1994 | Barker et al. | 215/230 |
| 5,358,117 | A | | 10/1994 | Adams | 206/534 |
| 5,577,335 | A | | 11/1996 | Tucker | 40/311 |
| 5,638,970 | A | | 6/1997 | Garby et al. | 215/219 |
| 5,694,882 | A | | 12/1997 | Marshall | 116/311 |
| 5,720,392 | A | | 2/1998 | Price | 206/534 |
| 5,984,122 | A | | 11/1999 | Barker et al. | 215/230 |
| 6,068,149 | A | | 5/2000 | Telega | 215/230 |
| 6,152,067 | A | | 11/2000 | Mathison | 116/308 |
| 7,032,535 | B2 | | 4/2006 | Halstead et al. | 116/308 |

* cited by examiner

*Primary Examiner* — Daniel S Larkin
*Assistant Examiner* — Irving A Campbell
(74) *Attorney, Agent, or Firm* — Fattibene and Fattibene LLC

(57) ABSTRACT

A collar having an inner and outer ring that move relative to each other, with one ring having time indicia and the other ring having an indicator window and an inner flexible membrane for placement over a medicine container. The indicator window is placed over the number representative of the time another dose of medicine is due. The device may be easily placed over a wide variety of different shaped medicament containers and acts as a reminder for the taking of a dose of medicine.

11 Claims, 7 Drawing Sheets

MEDICINE TRACKER AND DOSE INDICATOR

RELATED APPLICATION

This application claims the benefit of U.S. Provisional Application No. 61/306,775 filed Feb. 22, 2010.

FIELD OF THE INVENTION

The present invention relates in general to an aid for tracking the timing of the taking of a dose of a medicine and more particularly to an attachment for a medicament container to aid in the timing of the taking of a dose of medicine.

BACKGROUND OF THE INVENTION

Some medications require relatively strict adherence to the timing of their taking. Drug overdosing and under dosing has become a major issue and concern in the medical and pharmaceutical industry. While there are several containers that are used as aids in dosing medicines or drugs, they often require special packaging or containers that may be relatively complicated and are not applicable to many different kinds of containers.

One such container and cap intended to aid dosing is disclosed in U.S. Pat. No. 5,011,032 entitled "Patient Dosage Regimen Compliance Bottle Cap" and issuing to Rollman on Apr. 30, 1991. Therein disclosed is a dispenser closure that aids in the dispensing of a medicine. The cap includes a ring that has a slide attached thereto which can be moved by the patient circumferentially on the ring to stop at indicia on the top of the ring which reminds the patient which dose was last taken or which dose is yet to be taken.

Another indicator cap is disclosed in U.S. Pat. No. 5,638,970 entitled "Child-Resistant Indicator Cap" issuing to Garby et al on Jun. 17, 1997. Therein disclosed is a closure for a container including an indicator mechanism that records the removal of the closure from the container and also incorporates a child-resistant mechanism. This mechanism is relatively complex and yet does not remind a patient of the need for taking a dose of medicine but only the number of doses taken.

While these different inventions have aided in the dispensing of medicines, they have been applied to a relatively specific purpose and type of container. Therefore there is the need for a relatively simple device that can be applied to different types and shapes of containers for medicines that will remind a patient of when the last dose was taken or when the next dose must be taken.

SUMMARY OF THE INVENTION

The present invention is designed to provide consumers, caregivers, and patients with an easy to understand and easy to use device to track the time at which medicine was taken or the time when the next dose is due. The device of the present invention can be applied to different shapes and sizes of containers or bottles without the need for any modification or special closure. The present invention comprises an outer indicator ring having an indicator window thereon and an inner ring having indicia representative of time having an inner flexible membrane that is adjustable to different sizes and shapes of containers. The outer indicator ring rotates around and moves relative to the inner ring so that a number representative of a time of day or night is indicated within the indicator window. A user can easily move the outer indicator ring so that the indicator window indicates the time of the next dose or the time the last dose was taken.

It is an object of the present invention to provide a reminder for the taking of a dose of medicine.

It is another object of the present invention to prevent the improper dosing of a medicine.

It is an advantage of the present invention that it can be attached to different sizes of containers or bottles of medicine.

It is another advantage of the present invention that it is easy to use and can be placed on conventional medicine containers without the need for any modification.

It is a feature of the present invention that indicia on a ring represent time.

It is another feature of the present invention that a sliding indicator is rotated and selectively secured in position at a predetermined time indication.

It is yet another feature of the present invention that an inner flexible membrane can be placed over and adapted to a wide variety of different shaped medicine containers.

These and other objects, advantages, and features will become readily apparent in view of the following more detailed description.

DETAILED DESCRIPTION OF THE PREFERRED EMBODIMENT

Figure 1:
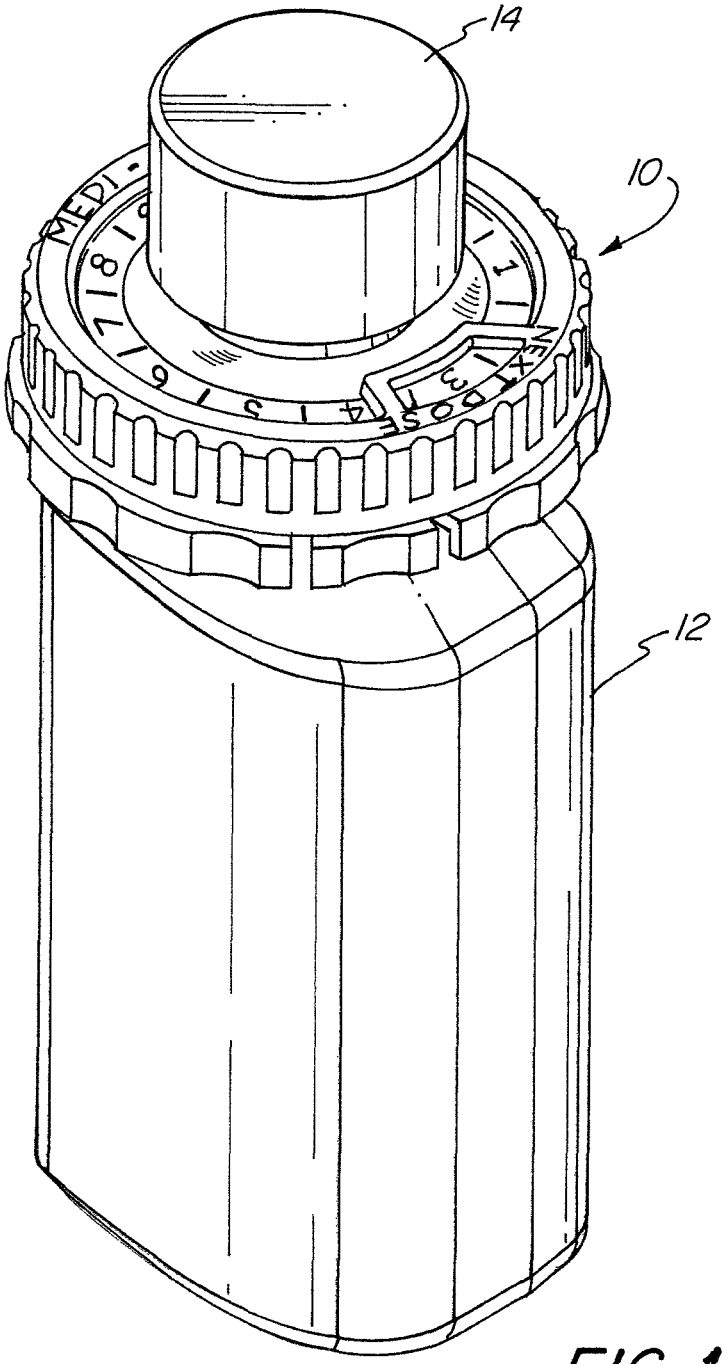
FIG. 1 is a perspective view illustrating placement of an embodiment of the present invention on a bottle or container.

FIG. 1 is a perspective view illustrating the medicine tracker or dose and time indicator 10 placed on a container or bottle 12 having cap 14. The bottle or container 12 may be any conventional medicine container that may contain pills or liquid and may be either prescription or non-prescription. The medicine tracker 10 is shown placed on the neck of a bottle 12. The medicine tracker 10 may be placed over the cap 14 or the cap 14 may be removed prior to placement of the medicine tracker 10 on the container 12.

Figure 2:
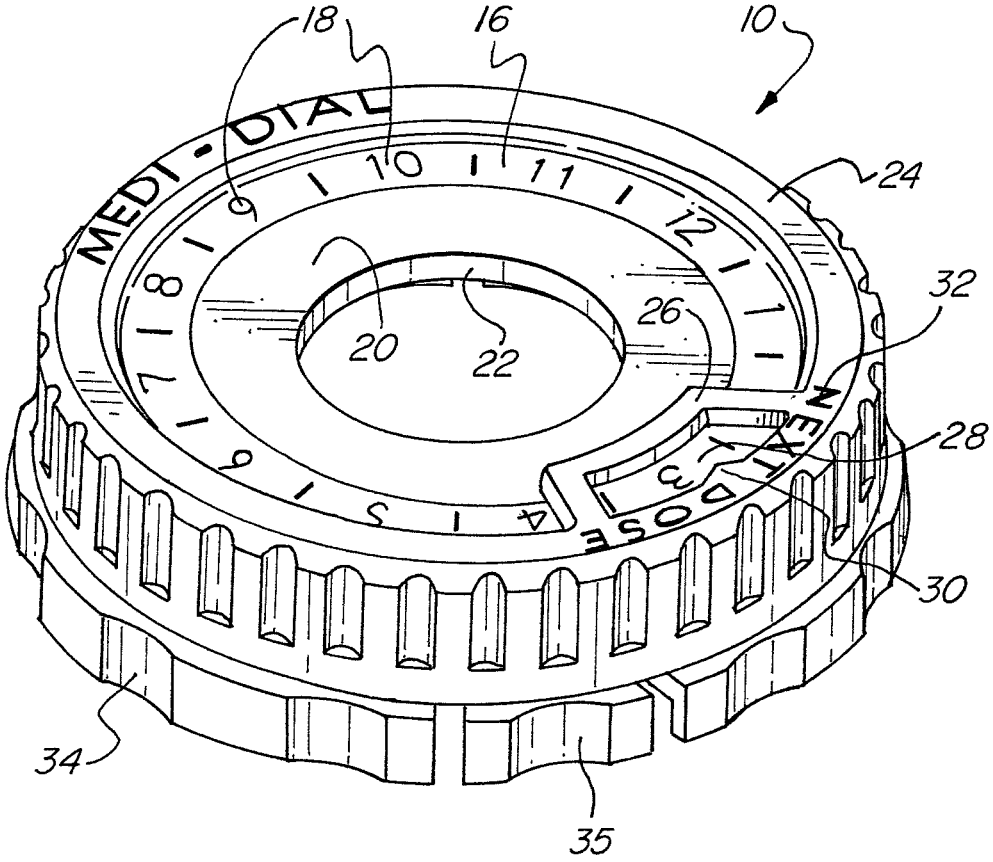
FIG. 2 is a perspective view of an embodiment of the present invention illustrated in FIG. 1.

FIG. 2 is a perspective view more clearly illustrating the design and structure of the medicine tracker or dose and time indicator 10. The medicine tracker 10 has an inner ring 16 having indicia 18 thereon representative of the hours in a day. Preferably numbers one to twelve, representative of hours, are spaced along the inner ring 16. Attached to or placed adjacent the inner ring 16 is a flexible membrane 20. The flexible membrane 20 has a hole 22 therein. Placed around the inner ring 16 and free to move relative thereto is an outer or indicator ring 24. The outer or indicator ring 24 has an indicator frame 26 with an indicator window 28 placed thereon. At the center of the indicator window 28 may be placed a pointer 30 that may be positioned adjacent one number of the indicia 18. This number may represent the timing of the taking of the next dose or the time the last dose was taken. The outer ring or indicator ring 24 moves relative to the inner ring so that the outer or indicator ring 24 can be positioned to a desired number of the indicia 18. Adjacent the indicator 28 may be dose indicia 32 indicating that the next dose of medicine is due. Support ring 34 may be placed under the out ring or indicator ring 24 and may aid as a guide in the positioning of the outer or indicator ring 24. The support ring 34 may be attached to the inner ring 16 or it may be separate therefrom. The support ring 34 may have a release 35 that when depressed may disengage the outer or indicator ring 24 permitting its free rotation around the inner ring 16. The outer ring or indicator ring 24 may have teeth circumferentially placed around the inner circumference with the release 35 having a pawl or latch to engage or disengage when pressed with the inner circumferential teeth formed on the inner surface of the outer or indicator ring 24. This forms a temporary locking means for preventing inadvertent relative movement between the outer indicator ring 24 and the inner indicia ring 16.

Figure 3:
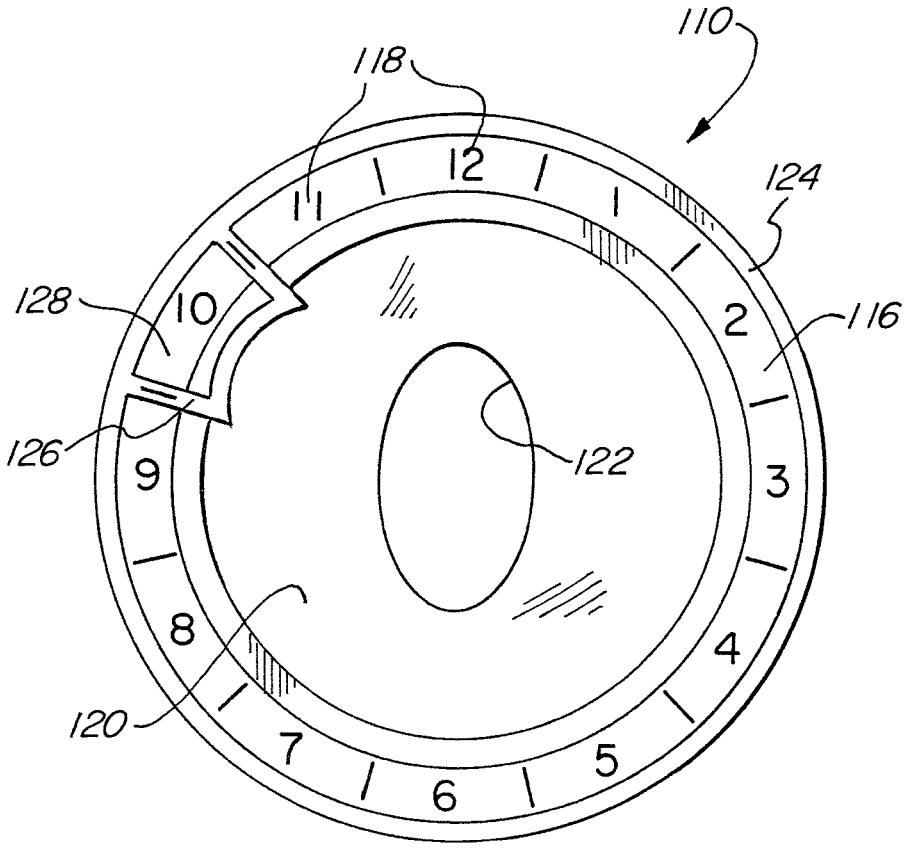
FIG. 3 is a plan view of another embodiment of the present invention.

FIG. 3 is a plan view illustrating another embodiment of the present invention. The medicine tracker 110 has an inner ring 116 with indicia 118 placed thereon. The indicia 118 represent hours or time. A flexible membrane 120 is preferably attached to the inner ring 116. A hole 122 is provided to fit over the container containing the medicine. The flexible membrane 120 may be made of any flexible material, such as rubber, plastic or other material so that the medicament tracker 110 is securely held on the container. An outer ring 124 that rotates relative to the inner ring 116 has an indicator frame 126 attached thereto. The indicator frame 126 has an indicator window 120 therein. The indicator window 128 may display any desired number of the indicia 118 that is representative of the time at which the next dose of medicine is due.

Figure 4A:
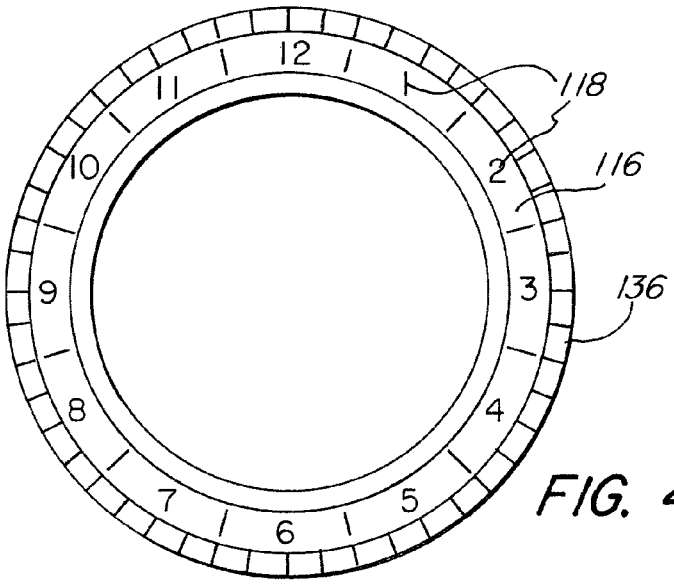
FIGS. 4A-C is an exploded plan view illustrating the different parts of an embodiment of the present invention illustrated in FIG. 3.
Figure 4B:
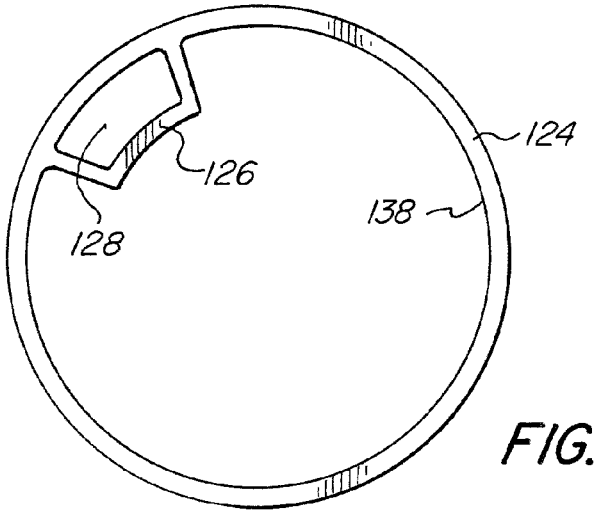
Figure 4C:
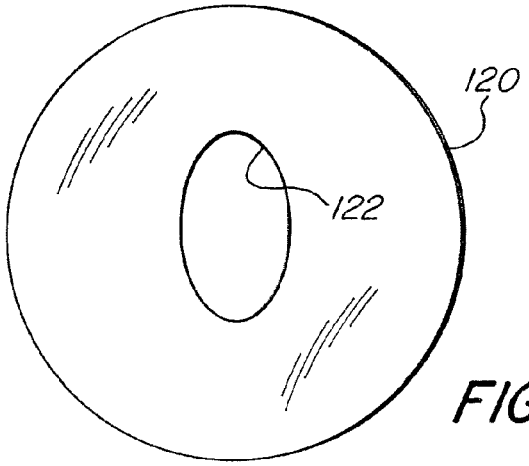

FIGS. 4A-C is an exploded plan view illustrating the different component parts of an embodiment of the present invention as illustrated in FIG. 3. FIG. 4A represents the inner ring 116 having indicia 118 thereon. The inner ring 116 also has an outer grooved edge 136 having circumferentially positioned grooves therein or teeth. FIG. 4B is a plan view illustrating the outer ring or indicator ring 124 having the indicator frame 126 and the indicator window 128 thereon. Also formed on the outer or indicator ring 124 on an interior surface thereof is an inner grooved edge or teeth 138 that mate with the outer grooved edge or teeth 136 formed on the inner ring 116, illustrated in FIG. 4A. The outer and inner grooved edges 136 and 138 form a temporary locking means for preventing inadvertent relative movement between the outer indicator ring 124 and the inner indicia ring 116. FIG. 4C is a plan view illustrating the flexible membrane 120 having a hole 122 therein. The flexible membrane 120 may be attached to the inner ring 116 or be sandwiched between the inner ring 116 and the outer indicator ring 124 so as to be held in place.

Figure 5:
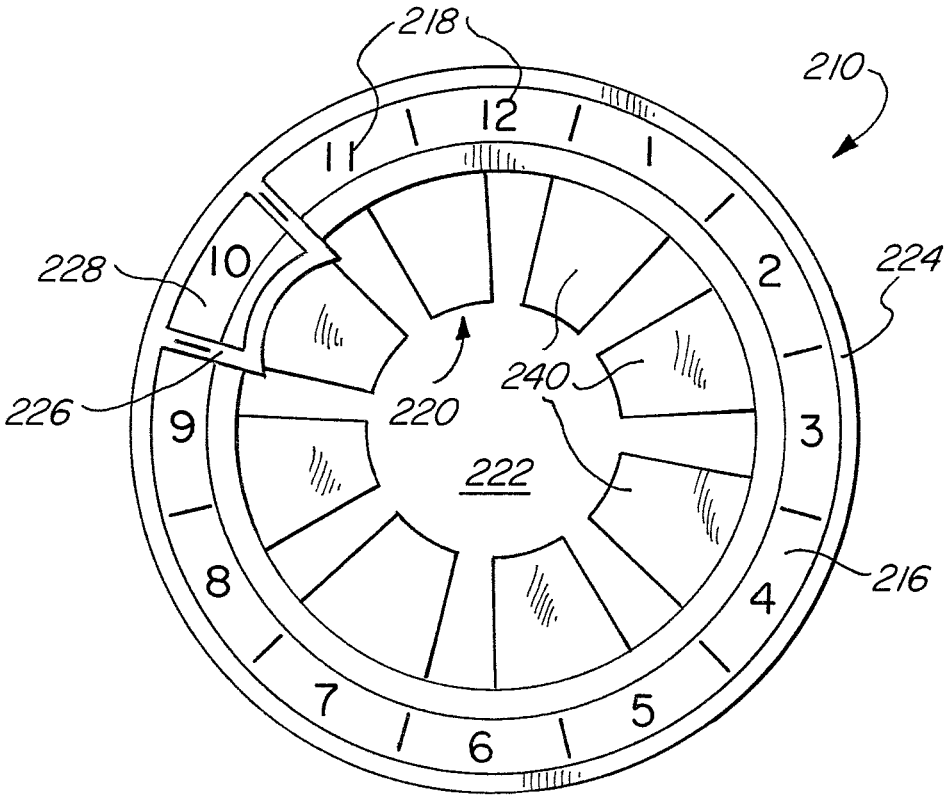
FIG. 5 is a plan view of another embodiment having a flexible membrane with fingers.

FIG. 5 is a plan view illustrating yet another embodiment of the present invention. The medicine tracker 210 has an inner ring 216 having indicia 218 thereon. An outer or indicator ring 224 has an indicator frame 226 and an indicator window 228 formed thereon. The outer ring or indicator ring 224 moves relative to the inner ring 216 so that the indicator window 228 can be positioned over any one of the numbers of the indicia 218. The flexible membrane 220, in this embodiment, is formed from a plurality of flexible fingers 240 that form around a hole 222. The flexible fingers 240 may be made of a flexible plastic or rubber material that is compliant and may adapt to different diameter containers that are forced through the hole 222 wherein the plurality of flexible fingers 240 are forced to conform to a larger or smaller diameter of the container as required.

Figure 6:
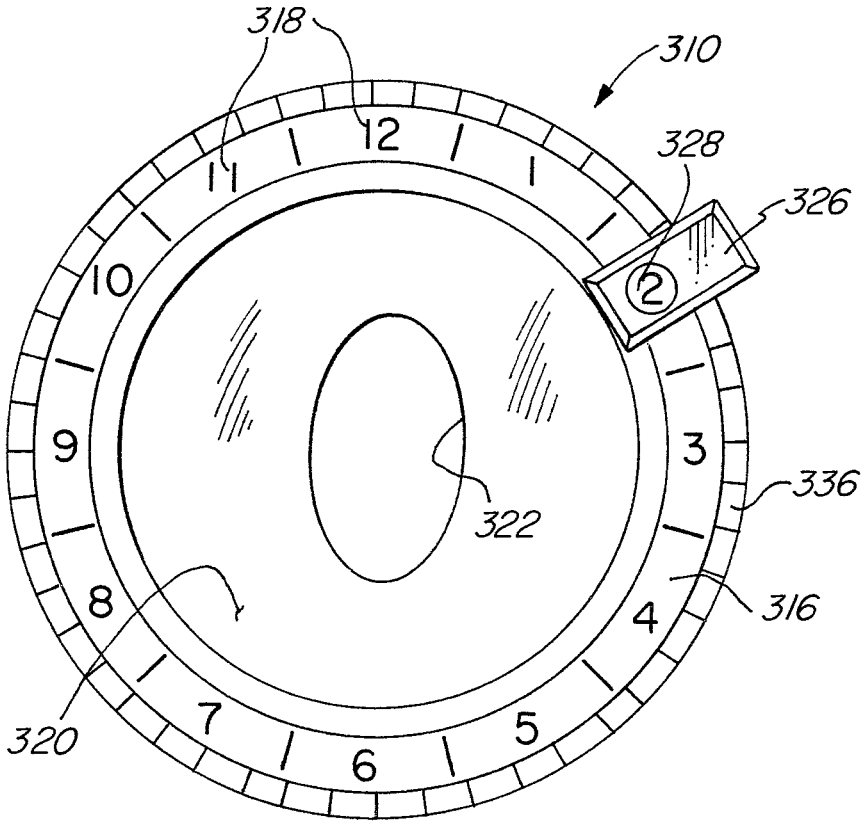
FIG. 6 is a plan view of another embodiment of the present invention having a sliding indicator.

FIG. 6 is yet another embodiment of the present invention. The medicine tracker 310 has an inner ring 316 with indicia 318 thereon. A flexible membrane 320 having a hole 322 thereon may be attached to the inner ring 316. A sliding indicator 326 having a window 328 therein may be slid circumferentially around the inner ring 316. An outer grooved edge 336 having teeth may be used to prevent the sliding indicator 326 from sliding too freely and may engage with mating teeth on the sliding indicator 326. This permits the sliding indicator 326 to be positioned to the selected number representative of the time of taking the next dose and helps to prevent it from being moved inadvertently.

Figure 7:
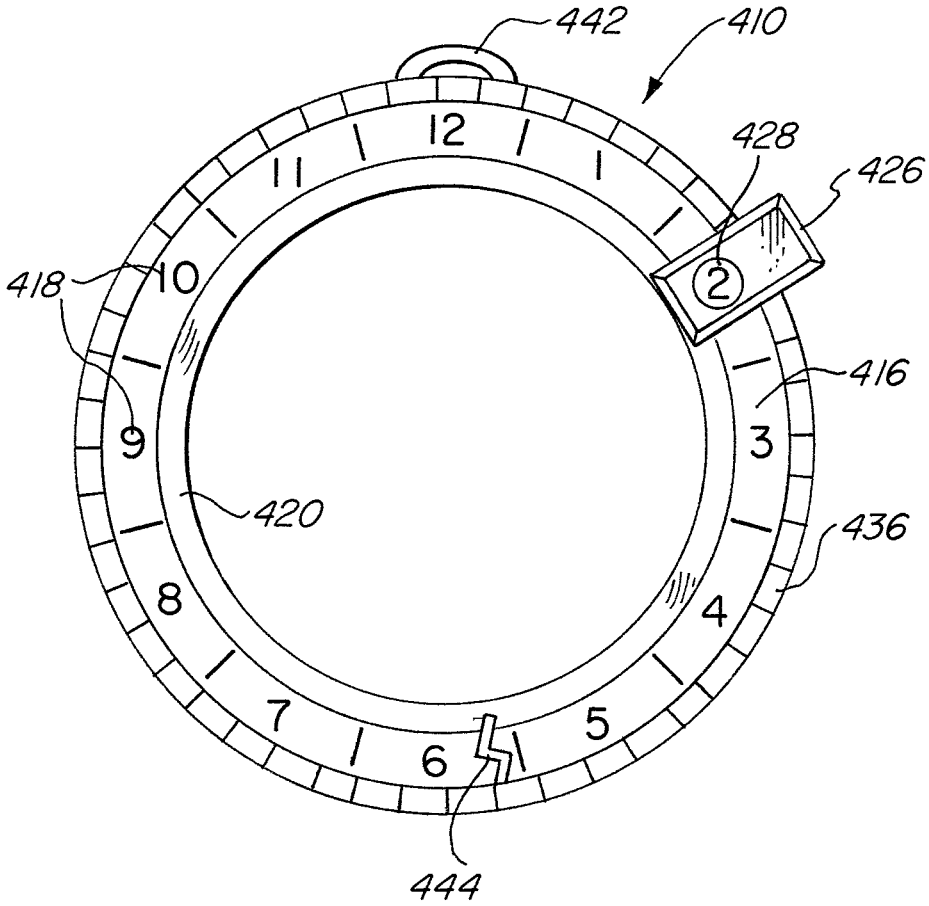
FIG. 7 is a plan view of yet another embodiment of the present invention that uses a hinge and latch for placement on a medicine container.

FIG. 7 is another embodiment of the present invention. In FIG. 7 a hinge and latch are used so that the ring can be split and placed over a container or bottle of medicine. The medicine tracker 410 has a split inner ring 416 having indicia 418 thereon. The inner ring 416 may have a flexible or compressible membrane 420 thereon that conforms and presses against a container when the split inner ring 416 is closed thereon. A sliding indicator 426 may be placed on the split inner ring 416 and permitted to move around the circumference thereof. Indicator window 428 may be placed over any desired number of the indicia 418. An outer grooved edge 436 may have teeth formed thereon that mate with teeth formed on the sliding indicator 426 to prevent inadvertent movement thereof. Latch 444 may be released and the split ring 416 opened, pivoting on hinge 442, to permit placement over the container and then secured by closing latch 444.

The present invention provides a simple device that can be placed on any medicine container or bottle without modification thereto. It can provide a valuable reminder about when the next dose of medicine is due, preventing either overdosing or under dosing of medicine. The present invention can take a variety of different forms or embodiments. The device may be placed manually on a medication vial, bottle, or container. The device may be removed and reused. The device may have a 12-hour clock face with line markings or other indicia representing time. The device may have smaller line markings placed half way between the hour markings to indicate thirty-minute intervals. The markings may be placed on the side or top of the ring. The device may be made of a hard plastic or other similar material. The device can be made to fit any different size of medicine container, either over the counter bottles or prescription containers. The device may be placed on the bottle cap or top or neck of a bottle or container. The sliding indicator ring may be assembled to the exterior plastic ring. The indicator window may take a variety of different shapes. The indicia or number markings may be in different time increments. The device may use a soft rubber interior ring to secure the device onto different shaped bottles or containers and prevent sliding. The flexible membrane or rubber ring may be attached permanently to the inner ring and may help to prevent or reduce liquid medicine spillage. The outer grooves, edges or serrated portions may be made of plastic or rubber. The device may be slid manually over the top or bottom of a container. The device may have an area to indicate a patient's name or identification. The device may also have a location for placing the name of the device or a logo. The device can be made in a number of different colors. The indicia or markings may be made fluorescent so as to be seen in the darkness. The device itself may be made fluorescent so that it can be seen in the darkness. The device may also have multiple indicators that may be used to identify a dosage amount or a quantity. The device may also include a manual or electronic alarm. The device may also incorporate an audible or visible alarm when a dose is due or missed. The device may also have indicia or markings that may be digital or electronic. The device may also be built into the cap of a container. The present invention therefore can take a variety of forms.

While the present invention has been described with respect to several different embodiments, it will be appreciated by those skilled in the art that various modifications may be made without departing from the spirit and scope of the present invention.

What is claimed is:

1. A medicine tracking device for use with a medicine container having a neck and a cap comprising:

an indicia ring having an inner and outer circumference and indicia thereon;

an indicator ring capable of moving relative to said indicia ring placed on the outer circumference of said indicia ring;

an indicator window placed on the indicator ring whereby selected indicia may be placed within said indicator window; and a flexible membrane attached to said indicia ring and extending inward past the inner circumference and having a hole of a size sufficient to permit the cap of the medicine container to fit there through and said flexible membrane to circumscribe the neck of the medicine container, whereby the medicine tracking device may be placed over the medicine container and held securely in position.

2. A medicine tracking device for use with a medicine container as in claim 1 wherein:

said flexible membrane comprises plastic.

3. A medicine tracking device for use with a medicine container as in claim 1 wherein:

said flexible membrane comprises a plurality of fingers.

4. A medicine tracking device for use with a medicine container as in claim 1 wherein:

said indicia ring and said indicator ring comprise a split ring; and further comprising a hinge and a latch formed on said indicia ring and said indicator ring, whereby said indicia ring and said indicator ring may be opened and placed around the medicine container and then latched.

5. A medicine tracking device for use with a variety of different size containers of medicine having different size circumferences comprising:

an outer indicator ring having an indicator window;

an inner indicia ring having an inner and outer circumference and indicia representative of time placed thereon, said outer indicator ring capable of moving relative to said inner indicia ring, whereby one of the indicia representative of time may be selectively positioned within the indicator window of said outer indicator ring; and a flexible membrane attached to said inner indicia ring and extending inward towards the center of said inner indicia ring past the inner circumference and having a hole of a size sufficient to permit said flexible membrane to circumscribe the different size circumferences of the variety of different size containers of medicine, whereby said flexible membrane of the medicine tracking device may be placed over the medicine container and held securely in position and the indicator window positioned to indicate a time when a next dose of medicine is due.

6. A medicine tracking device for use with a medicine container as in claim 5 wherein:

said flexible membrane comprises plastic.

7. A medicine tracking device for use with a medicine container as in claim 5 wherein:

said flexible membrane comprises a plurality of fingers.

8. A medicine tracking device for use with a medicine container as in claim 5 wherein:

said inner indicia ring and said outer indicator ring comprise a split ring; and further comprising a hinge and a latch formed on said inner indicia ring and said outer indicator ring, whereby said inner indicia ring and said outer indicator ring may be opened and placed around the medicine container and then latched.

9. A medicine tracking device for use with a variety of different size containers of medicine and used to indicate when a next dose of medicine is due to be taken comprising:

a medicine container having a perimeter;

an outer indicator ring having an indicator window;

an inner indicia ring having indicia representative of twelve hours placed thereon, said outer indicator ring capable of moving relative to said inner indicia ring, whereby one of the indicia representative of twelve hours may be selectively positioned within the indicator window of said outer indicator ring;

next dose indicia placed on said outer indicator ring adjacent the indicator window indicating a time for taking the next dose of medicine;

temporary locking means, formed on said outer indicator ring and said inner indicia ring, for preventing inadvertent relative movement between said outer indicator ring and said inner indicia ring;

a flexible membrane having a hole therein attached to said inner indicia ring, said medicine container placed through said hole with said flexible membrane circumscribing the perimeter of said medicine container, whereby said flexible membrane of the medicine tracking device may be placed over the medicine container and held securely in position and the indicator window positioned to indicate a time when a next dose of medicine is due to be taken.

10. A medicine tracking device for use with a variety of different size containers of medicine and used to indicate when a next dose of medicine is due to be taken as in claim 9 wherein:

said flexible membrane comprises a plurality of fingers.

11. A medicine tracking device for use with a variety of different size containers of medicine and used to indicate when a next dose of medicine is due to be taken as in claim 9 wherein:

said inner indicia ring and said outer indicator ring comprise a split ring; and further comprising a hinge and a latch formed on said inner indicia ring and said outer indicator ring, whereby said inner indicia ring and said outer indicator ring may be opened and placed around the medicine container and then latched.

* * * * *